US007281915B2

(12) United States Patent
Billarant

(10) Patent No.: US 7,281,915 B2
(45) Date of Patent: Oct. 16, 2007

(54) OVERMOULD WITH ANTI-INTRUSION RIBS

(75) Inventor: Fabrice Billarant, Nantes (FR)

(73) Assignee: Aplix (FR)

( * ) Notice: Subject to any disclaimer, the term of this patent is extended or adjusted under 35 U.S.C. 154(b) by 0 days.

(21) Appl. No.: 11/436,418

(22) Filed: May 18, 2006

(65) Prior Publication Data

US 2006/0269635 A1 Nov. 30, 2006

(30) Foreign Application Priority Data

May 27, 2005 (FR) ..... 05 05372

(51) Int. Cl.
*B29C 44/58* (2006.01)

(52) U.S. Cl. ..... 425/3; 425/DIG. 33; 425/4 R; 425/116; 425/127; 428/99; 428/100

(58) Field of Classification Search ..... 428/99, 428/100; 425/116, 127, 3, DIG. 33, 4 R
See application file for complete search history.

(56) References Cited

U.S. PATENT DOCUMENTS 4,842,916 A * 6/1989 Ogawa et al. ..... 428/100
5,061,540 A * 10/1991 Cripps et al. ..... 428/100
6,720,059 B2 * 4/2004 Fujisawa et al. ..... 428/100

* cited by examiner

*Primary Examiner*—Tim W. Heitbrink
*Assistant Examiner*—Marissa W. Chaet
(74) *Attorney, Agent, or Firm*—Renner, Kenner, Greive, Bobak, Taylor & Weber

(57) ABSTRACT

Overmould comprising a base having a central section, from a first side of which hooks project which form the male part of a self-gripping member, two sections forming selvages, laterally from each side of the central section, and magnetic means which can cooperate with a magnet in order to attract the overmould, is characterized in that the selvages each comprise at least two ribs, preferably at least three or four ribs, which project from the selvages on the same side of the base as the hooks.

13 Claims, 3 Drawing Sheets

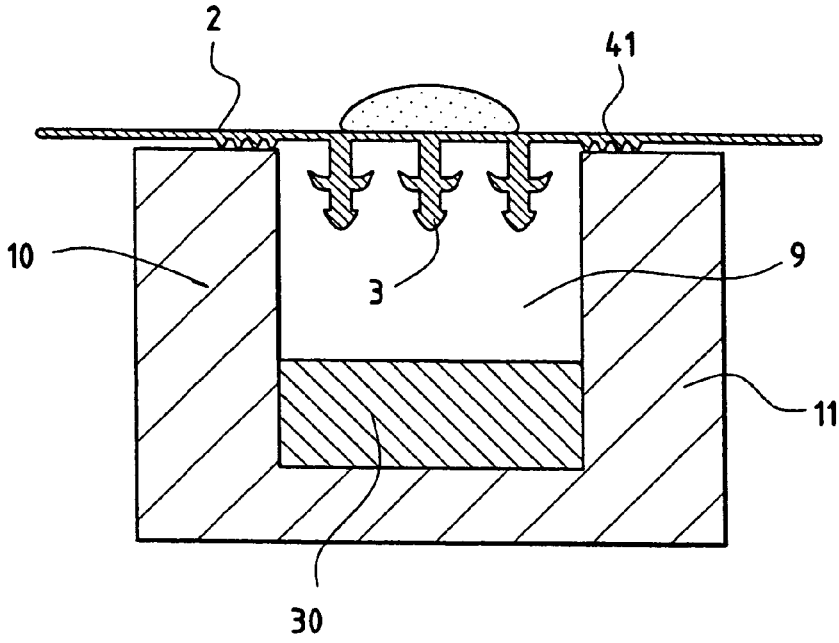
FIG.3
FIG.6
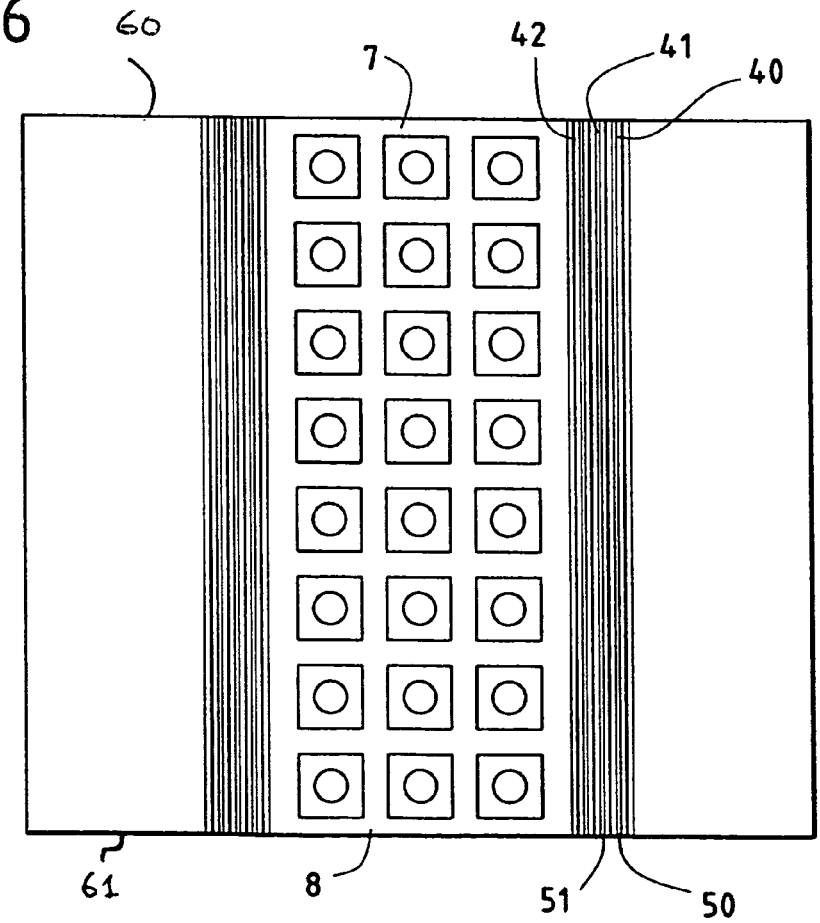

OVERMOULD WITH ANTI-INTRUSION RIBS

TECHNICAL FIELD

The present invention relates to an overmould which is intended to be fixed to an object cast in a foam in a mould, this overmould comprising a base having a central section, from a first side of which hooks project which form the male part of a self-gripping member, and two sections forming selvages on each side of the central section, as well as magnetic means which can cooperate with a magnet arranged at the bottom of a cavity delimited by one or more walls at the bottom of the mould. The magnet attracts the overmould which is preliminarily placed on the upper edges of the walls of the cavity with the hooks inside the cavity and presses its selvages against the upper edges of the walls in order to thus ensure sealtightness of the cavity, in which the hooks are arranged, in such a manner that foam can be transferred into the mould without it infiltrating into the cavity and contaminating the hooks by coming into contact with them and causing them to lose their gripping character in relation to loops of a self-gripping closure. Once the foam has hardened it forms a moulded object to which the overmould is fixed, the overmould having hooks which have not taken in the foam owing to the protection provided by the cavity and these hooks then being able to cooperate with loops in order, for example, to fix a fabric to the object moulded in foam, for example a motor car seat cushion.

BACKGROUND ART

Overmoulds of this type are already known from the prior art. These overmoulds of the prior art have the drawback in particular that their sealtightness in relation to the foam which is poured into the mould is not good at the interface between the selvages and the upper edges of the walls delimiting the hook protection cavity. It is necessary to use magnets with strong magnetization which are costly. Besides, if the selvages are placed on the cavities of the moulds in such a way that they project beyond the walls in order to be suspended beyond the walls in the mould itself which will serve to form the final moulded object with a view to good anchoring of the overmould in the moulded object, in particular by at least two contact sides, the foam which has been poured then tends to exert—when taking as a whole—an upward force on its suspended sections of the selvages which tends to slightly dislodge the overmould from the upper edges of the walls and to further reduce the sealtightness at the interface between these selvages and the upper edge of the vertical walls.

DISCLOSURE OF THE INVENTION

It is an object of the present invention to overcome the above-mentioned drawbacks of the overmoulds of the prior art by proposing an overmould which, when placed by at least a section of its selvages on the upper edge of the walls delimiting a cavity for protecting the hooks from the pouring of foam, exhibits better sealtightness in relation to the infiltration of foam at the interface between the selvages and the upper edges, and this being with an equal magnetization force, or a sealtightness equivalent to those of the prior art with less magnetization. Besides, it is also possible according to the invention to obtain a moulded object to which the overmould is properly fixed, particularly through contact with at least a section of its two upper and lower sides, without having to provide greater magnetization of the magnet.

When the overmould is placed on the upper edges of the delimitation walls of a cavity for protecting the hooks at the bottom of the mould intended for forming the moulded object to which the overmould is intended to be fixed, decompression chambers are formed, with the ribs, delimited by the selvages, the ribs and the upper edges of the delimitation walls of the cavity. These decompression chambers allow the sealtightness of the interface between the selvages and upper edges to be increased, this being achieved with the same magnetization. In fact, on the one hand, by a point effect, the magnetization force—instead of being distributed over the surface—is now distributed by points or lines (along the tops of the ribs), these points or lines thus having greater application force than pressure over the surface with the same magnetization. On the other hand when the foam is poured there are low pressure air pockets in the decompression chambers. When one of the ribs loses contact under the effect of the pressure of the foam and this penetrates into a first of these chambers, the outermost chamber in relation to the hooks, a sort of decompression or expansion of the foam is produced, thus congealing, tending to stop the progression towards the following chamber.

According to a preferred embodiment the ribs have a pointed form in cross-section, particularly in the shape of a triangle.

According to a preferred embodiment the ribs have a height (perpendicularly to the base) which is lower than that of the hooks, and in particular lower by a factor of at least two, more preferably at least five.

According to an embodiment of the invention the base is substantially planar.

According to a preferred embodiment of the invention the region of the hooks has a width (in the direction from the end of one selvage to the end of the other selvage) of less than 10 mm, preferably between 3 and 10 mm.

According to a further preferred embodiment of the invention the ribs have a hook-like form, having a pointed section which is inclined in relation to the body of the rib, the inclined point preferably being oriented in the direction away from the region of the hooks.

According to a further preferred embodiment of the invention the hooks are realized in the form of longitudinal rows, the number of rows preferably being less than or equal to three, with hooks in the shape of fir trees and the rows being substantially parallel to the ribs.

According to a particularly preferred embodiment of the invention, the base consists of polyamide (nylon), particularly of type 6 to 12, preferably 12, or polyamide 6-6 (nylon 6-6).

According to a preferred embodiment of the invention the selvages have a width less than 15 mm, particularly between 5 and 12 mm.

The present invention also relates to an assembly comprising a mould, from the bottom of which one or more walls project, preferably being substantially vertical, delimiting inside a cavity closed on all sides with the exception of the top which is open, the opening of the cavity being delimited by the upper edges of the walls, and on the other hand an overmould according to the invention, of which the selvages rest at least in part on the upper edges of the walls by means of the ribs.

According to a preferred embodiment of the invention the selvages project laterally beyond the walls of the outer side of the cavity.

According to the invention it is now possible to bring about contact between the overmould and the foam of the moulded object through at least a section of its upper and lower sides without having to provide greater magnetization in order to work against the lifting of the overmould through the effect of the action of the foam cast in the bottom which rises as it becomes paste-like.

Finally, the present invention also relates to a moulded object in a foam to which an overmould according to the invention is fixed.

BRIEF DESCRIPTION OF THE DRAWINGS

The drawings show an embodiment of the invention purely by way of example.

PREFERRED EMBODIMENT FOR CARRYING OUT THE INVENTION

Figure 1:
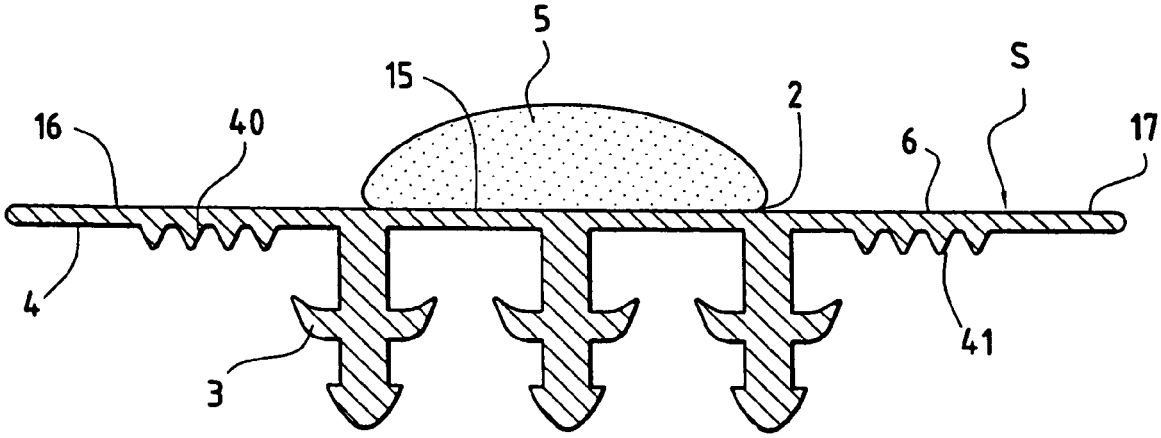
FIG. 1 is a perpendicular cross-section of an overmould according to the invention, FIG. 2 a cross-section of the overmould according to the invention placed on a cavity formed at the bottom of a mould, FIG. 3 a cross-section of the same overmould according to the invention as in FIG. 1 or 2, placed on another cavity formed at the bottom of a mould, FIG. 4 a general plan of a moulded object obtained after solidification of the foam using the assembly described in FIG. 2, FIG. 5 a general plan of a moulded object obtained after solidification of the foam obtained using the assembly of FIG. 3, and FIG. 6 the overmould of FIG. 1 seen from below.

In FIG. 1 the overmould comprises a base 2 which is substantially planar. Hooks 3 project from one side (lower side) 4 of the base wherein they are arranged in a strip 15 of hooks. Two regions 16 and 17 forming selvages extend laterally from each side of the strip 15. A resin 5 made from a material which can be attracted by a magnet, particularly ferromagnetic metal, is provided in the form of a rib, being fixed in particular through adhesion or mere solidification of the resin, on the upper side 6 of the base. The hooks are arranged in rows, three rows being shown in FIG. 1. In general the base has a length (in the perpendicular direction in the drawing) which is much greater than its width. In the same way the rows of hooks are arranged in a strip of which the length is greater than the width. The strip 15 of hooks does not, however, extend longitudinally from one end to the other of the base. In fact two regions 7, 8 are provided at the final longitudinal ends of the hook strip without hooks. These two regions 7, 8 allow the base to be placed with the hooks facing downwards on a cavity 9 at the bottom of the mould at the longitudinal ends of the base 2. The width of the hook strip is between 3 and 10 mm. The width of each selvage 16 and 17 is for example between 2 and 30 mm, preferably between 7 and 15 mm. Longitudinal ribs 40, 41, 42 which are parallel to each other (that is to say extending along the perpendicular in FIG. 1) project respectively from the selvages 16 and 17 on the same side of the base 2 as the hooks. Between these three ribs 40, 41, 42 two grooves 50, 51 are formed. The ribs have a height calculated perpendicularly to the selvages 16 or 17 between 0.2 mm and 4 ram. In particular these ribs have a height below that of the hooks, in particular being less than half of that of the hooks, more preferably being less than a quarter of that of the hooks. The ribs 40, 41, 42 have a triangular cross-section, the point facing downwards. The selvages extend laterally on the side of the ribs which is remote from the hooks over a distance which is between 1 mm and 15 mm. In particular this distance can be greater than the distance between the hooks and the ribs.

Figure 2:
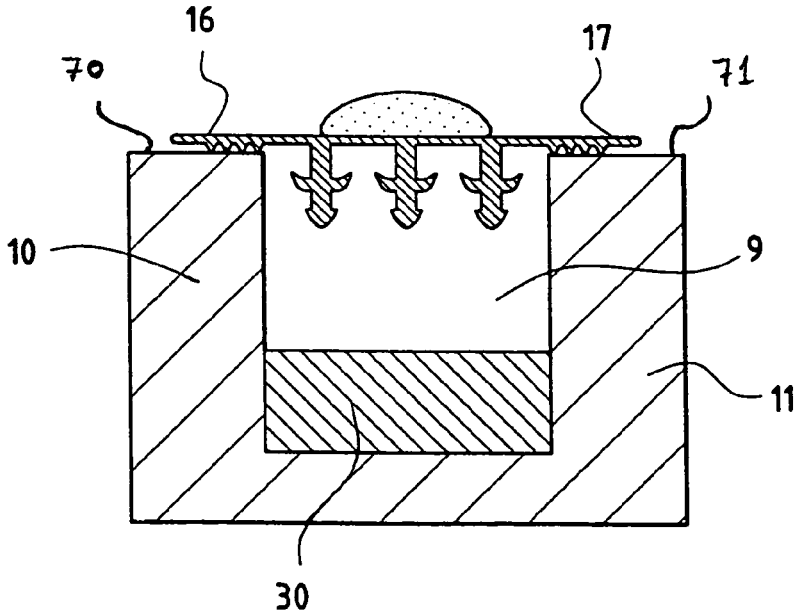

FIG. 2 shows a first way of arranging the overmould on a cavity at the bottom of a mould. A cavity is formed at the bottom of a mould being delimited by vertical walls 10 and 11 having upper surfaces 70, 71 on which the selvages 16 and 17 of the overmould of FIG. 1 are supported at least in part by means of their ribs 40, 41, 42, particularly through contact in a line corresponding to the sharp-edged tops or points of the triangles. In the case of the assembly shown in this FIG. 2 the selvages do not project beyond the vertical walls on the outer side of the cavity 9. A magnet is arranged at the bottom of the cavity 9. This magnet 30 exerts an attracting force on the metallic resin 5 in such a way as 5 to attract the overmould and thus apply the selvages 16 and 17 in a sealtight way to the upper surfaces of the vertical walls 10 and 11. The ribs 40, 41, 42 thus form, with these upper surfaces, decompression chambers 50, 51. When the foam is transferred into the mould which contains the cavity 9 at the bottom there is strong pressure in the mould. At the same time there is air in the decompression chambers 50 and 51, that is to say negative pressure which tends to increase the sealtightness of the interface between the selvages 16, 17 and the respective edges of the vertical walls 10 and 11. Besides, the application force is increased by a point effect. In fact the force attracting the resin through the magnet which is translated into an application force of the selvages 16 and 17 on the upper edges of the upper vertical walls 10 and 11 is translated by a greater application force concentrated on the points and this being for a constant attracting force.

Figure 4:
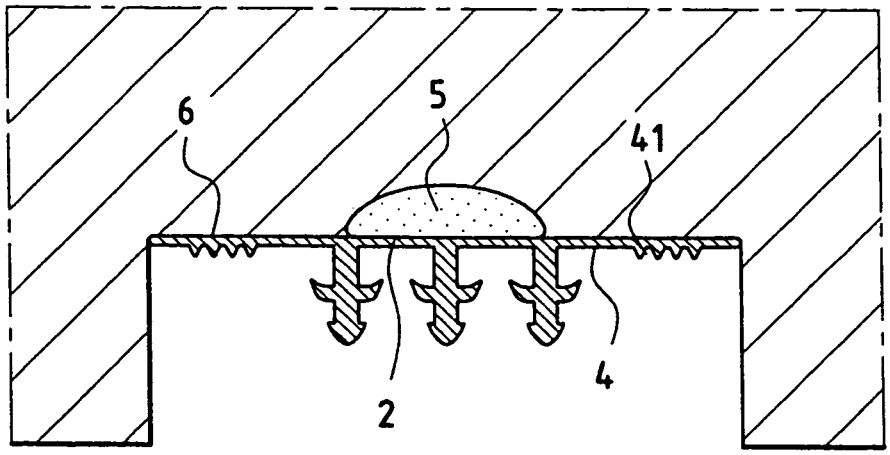
Figure 5:
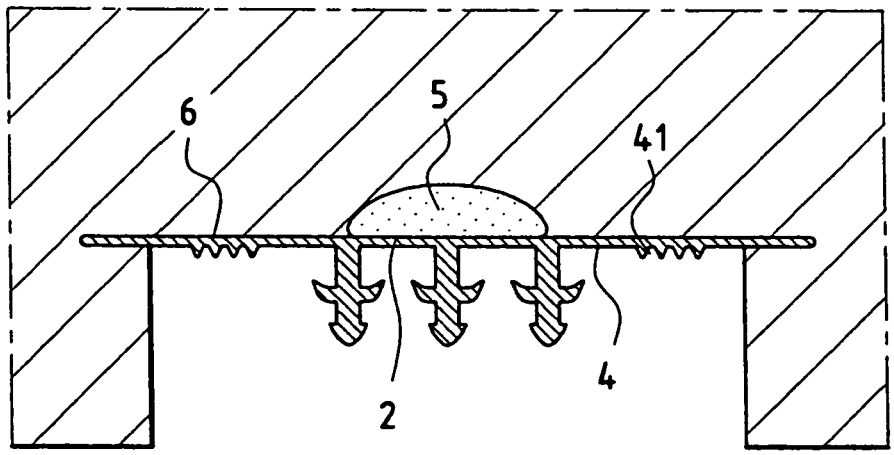

FIG. 4 shows the arrangement of the overmould of FIG. 1 on a cavity having selvages which project from the outer side of the vertical walls. The fact that the selvages are arranged at the start so as to project beyond the walls allows a better connection of the moulded object and the overmould because the foam is in contact with the overmould through at least a section of its two upper and lower sides in the final moulded object. According to one of the advantages of the invention the selvages can go beyond the vertical walls without having to also increase the magnetization force in relation to the prior art. In such a case in fact, the foam which has been poured and which is found at the bottom of the mould expands when it begins to take as a whole, starting from the bottom of the mould, and tends to lift the selvages from the bottom, and to infiltrate into the cavity and contaminate the hooks. According to the prior art, consequently, there were only arrangements according to FIG. 2. Owing to the ribs, for the same magnetization, there is better application of the selvages on the upper edges and, in spite of the lifting of the foam and the associated force applied upwards to the selvages, the overmould retains good sealtightness at the interface between the upper edges and selvages. At the same time there is better "anchoring" of the overmould in the foam. Moulded objects can be seen in FIGS. 4 and 5 which comprise an overmould which is fixed to them obtained respectively from FIG. 2 and FIG. 3. In fact, through this projection it is ensured that the overmould is now in contact with the foam through at least a section of its two upper and lower sides.

As a base material, besides polyamide 6, 11 or 12 or polyamide 6-6, one can also use polyethylene, polypropylene or any other thermoplastic or thermo-25 setting substance, in particular polyester.

The foam poured is a material which is compatible with that of the overmould, that is to say it fixes to it well when it solidifies in contact with the overmould. In particular a polyether or polyurethane foam can be chosen. Other materials are of course also possible.

The ribs are separated from each other by a planar section of the selvage, this planar section extending from one rib to the following rib by a distance which can be between 0.3 mm and 2 mm.

The ribs 40, 41, 42 extend in a substantially continuous way over essentially the whole length (measurement in the perpendicular direction in the plan of FIG. 1, 4 or 5 or in the vertical direction in FIG. 2), preferably along the region of the central section where the hooks are found, more preferably from one edge 60 of the overmould 10 to the other edge 61. The continuity of the ribs is such that foam cannot pass across these ribs in the direction of FIG. 6 going from left to right or vice versa, that is to say perpendicularly to the ribs.

What is claimed is:

1. An overmould comprising a base and magnetic means which can cooperate with a magnet in order to attract the overmould, said base comprising a central section having a length in a first direction and a width in a second direction perpendicular to said first direction, hooks forming the male part of a self gripping member projecting from a first side of said central section, said central section being interposed in said second direction between a first selvage forming section and a second selvage forming section, at least two ribs projecting from each of said selvage forming sections on the same side of the base as said first side and extending continuously along said length of said central section so that foam cannot pass through any of said ribs in said second direction.

2. The overmould of claim 1, wherein said at least two ribs are mutually parallel.

3. The overmould of claim 1, wherein said ribs all extend from one side of said base to an opposite side.

4. The overmould of claim 1, wherein said ribs extend along said first direction.

5. The overmould of claim 1, characterized in that the ribs have a pointed shape in cross-section, particularly triangular.

6. The overmould of claim 1, characterized in that the ribs have a hook-like shape, having a pointed section inclined in relation to the body of the rib, the inclined point preferably being oriented in the direction away from the region of the hooks.

7. The overmould of claim 1, characterized in that the ribs have a height (perpendicularly to the base) which is lower than that of the hooks, and in particular lower by a factor of at least two, more preferably at least five.

8. The overmould of claim 1, characterized in that the base is formed so as to be substantially planar.

9. The overmould of claim 1, characterized in that the selvages extend laterally from the side of the ribs which is remote from the hooks over a distance which is greater than the distance between the hooks and the ribs.

10. The overmould of claim 1, characterized in that at least three ribs are provided.

11. An assembly comprising a mold, from the bottom of which one or more walls project, preferably vertical walls, delimiting inside a cavity which is closed on all sides with the exception of the top which is open, the opening of the cavity being delimited by the upper edges of the walls, and on the other hand an overmould according to claim 1, of which the selvages rest at least partially on the upper edges of the walls by means of the ribs.

12. The assembly of claim 11, characterized in that the selvages project laterally beyond the walls of the outer side of the cavity.

13. A moulded object, of foam, to which an overmould is fixed according to claim 1.

* * * * *